US007084823B2

(12) United States Patent
Caimi et al.

(10) Patent No.: US 7,084,823 B2
(45) Date of Patent: Aug. 1, 2006

(54) INTEGRATED FRONT END ANTENNA

(75) Inventors: Frank M. Caimi, Vero Beach, FL (US); John Charles Farrar, Indialantic, FL (US); Kerry Lane Greer, Melbourne Beach, FL (US); Michael H. Thursby, Palm Bay, FL (US); Donald A. Innis, Melbourne, FL (US)

(73) Assignee: SkyCross, Inc., Melbourne, FL (US)

( * ) Notice: Subject to any disclaimer, the term of this patent is extended or adjusted under 35 U.S.C. 154(b) by 0 days.

(21) Appl. No.: 10/787,549

(22) Filed: Feb. 26, 2004

(65) Prior Publication Data

US 2004/0227683 A1 Nov. 18, 2004

Related U.S. Application Data

(60) Provisional application No. 60/450,191, filed on Feb. 26, 2003.

(51) Int. Cl.
*H01Q 11/12* (2006.01)

(52) U.S. Cl. ..... 343/742

(58) Field of Classification Search ..... 343/742, 343/850, 853; 455/125, 129, 269
See application file for complete search history.

(56) References Cited

U.S. PATENT DOCUMENTS 5,300,941 A 4/1994 Hemmie et al.
5,432,489 A 7/1995 Yrjola
5,521,561 A 5/1996 Yrjola et al.
5,523,768 A 6/1996 Hemmie et al.
5,790,080 A 8/1998 Apostolos
5,930,682 A 7/1999 Schwartz et al.
6,437,756 B1 * 8/2002 Schantz ..... 343/866
6,556,807 B1 4/2003 Horie et al.
6,571,110 B1 5/2003 Patton et al.
6,593,886 B1 * 7/2003 Schantz ..... 343/700 MS
6,597,321 B1 7/2003 Thursby et al.
6,845,253 B1 * 1/2005 Schantz ..... 455/575.7

OTHER PUBLICATIONS

Harvey, A. F.; "Periodic and Guiding Structures at Microwave Frequencies"; IRE Transactions on Microwave Theory and Techniques; Jan. 1960; pp. 30-61.

* cited by examiner

*Primary Examiner*—Don Wong
*Assistant Examiner*—Huedung X. Cao
(74) *Attorney, Agent, or Firm*—John L. DeAngelis, Jr.; Beusse Wolter Sanks Mora & Maire, P.A.

(57) ABSTRACT

A radio frequency transmitting and receiving apparatus comprising a filter and an antenna, wherein the input reactance of the antenna is substantially equal in magnitude and opposite in sign to the output reactance of the filter. This reactance relationship permits the antenna and filter to be collocated and avoids transformation of the input and output impedances to the conventional 50 ohms such that the filter and antenna can be connected with a conventional 50 ohm transmission line.

19 Claims, 9 Drawing Sheets

INTEGRATED FRONT END ANTENNA

This application claims the benefit of the provisional patent application entitled Integrated Front End Antenna filed on Feb. 26, 2003, and assigned application number 60/450,191. This application further claims the benefit of the non-provisional patent application entitled Antenna Including Intergrated Filter, files on Feb. 4, 2002 assigned application Ser. No. 10/066,937; which has been abandoned, which claims the benefit of the provisional application filed on Feb. 2, 2001 and assigned application number 60/266,245.

FIELD OF THE INVENTION

The present invention is directed generally to an antenna for transmitting and receiving electromagnetic signals, and more specifically to an antenna integrated with certain components for receiving and transmitting the electromagnetic signals via the antenna.

BACKGROUND OF THE INVENTION

It is known that antenna performance is dependent on the size, shape, and material composition of constituent antenna elements, as well as the relationship between the wavelength of the received/transmitted signal and certain antenna physical parameters (that is, length for a linear antenna and diameter for a loop antenna). These relationships and physical parameters determine several antenna performance characteristics, including: input impedance, gain, directivity, signal polarization, radiation resistance and radiation pattern.

Generally, an operable antenna should have a minimum physical antenna dimension on the order of a half wavelength (or a quarter wavelength above a ground plane) (or a multiple thereof) of the operating frequency to limit energy dissipated in resistive losses and maximize transmitted energy. A quarter wavelength antenna (or multiple thereof) operative above a ground plane, exhibit properties similar to a half wavelength antenna. Generally, communications product designers prefer an efficient antenna that is capable of wide bandwidth and/or multiple frequency band operation, electrically matched to the transmitting and receiving components of the communications system, and operable in multiple modes (e.g., selectable signal polarizations and selectable radiation patterns).

Certain antennas, such as a meanderline antenna described below, present an electrical dimension that is not equivalent to a physical dimension of the antenna. Thus, such antennas should exhibit an electrical dimension that is a half wavelength (or a quarter wavelength above a ground plane) or a multiple thereof Quarter wavelength antennas operable in conjunction with a ground plane are commonly used as they present smaller physical dimensions than a half wavelength antenna at the antenna resonant frequency. But, as the resonant frequency of the signal to be received or transmitted decreases, the antenna dimensions proportionally increase. The resulting larger antenna, even at a quarter wavelength, may not be suitable for use with certain communications devices, especially portable and personal communications devices intended to be carried by a user.

A meanderline-loaded antenna (MLA) represents a slow wave antenna structure where the physical dimensions are not equal to the effective electrical dimensions. Such an antenna de-couples the conventional relationship between the antenna physical length and resonant frequency, permitting use of such antennas in applications where space for a conventional antenna is not available. Generally, a slow-wave structure is defined as one in which the phase velocity of the traveling wave is less than the free space velocity of light. The wave velocity is the product of the wavelength and the frequency and takes into account the material permittivity and permeability, i.e., $c/((\mathrm{sqrt}(\in_r)\mathrm{sqrt}(\mu_r))=\lambda f$. Since the frequency remains unchanged during propagation through a slow wave structure, if the wave travels slower than the speed of light (i.e., the phase velocity is lower), the wavelength within the structure is lower than the free space wavelength. Thus, for example, a half wavelength slow wave structure is shorter than a half wavelength structure where the wave propagates at the speed of light (c). Slow wave structures can be used as antenna elements (i.e., feeds) or as antenna radiating structures.

Since the phase velocity of a wave propagating in a slow-wave structure is less than the free space velocity of light, the effective electrical length of these structures is greater than the effective electrical length of a structure propagating a wave at the speed of light. The resulting resonant frequency for the slow-wave structure is correspondingly increased. Thus if two structures are to operate at the same resonant frequency, as a half-wave dipole for instance, the structure propagating the slow wave is physically smaller than the structure propagating the wave at the speed of light.

Slow wave structures are discussed by A. F. Harvey in his paper entitled *Periodic and Guiding Structures at Microwave Frequencies*, in the IRE Transactions on Microwave Theory and Techniques, January 1960, pp. 30–61 and in the book entitled *Electromagnetic Slow Ware Systems* by R. M. Bevensee published by John Wiley and Sons, copyright 1964. Both of these references are incorporated by reference herein.

A typical meanderline-loaded antenna (also known as a variable impedance transmission line (VITL) antenna) is disclosed in U.S. Pat. No. 5,790,080. The antenna comprises two vertical conductors and a horizontal conductor, with a gap separating each vertical conductor from the horizontal conductor.

The antenna further comprises one or more meanderline variable impedance transmission lines electrically bridging the gap between the horizontal conductor and each vertical conductor. Each meanderline coupler is a slow wave transmission line structure carrying a traveling wave at a velocity less than the free space velocity. Thus the effective electrical length of the slow wave structure is considerably greater than it's actual physical length. The relationship between the physical length and the electrical length is given by $$l_e = \in_{eff} \times l_p$$

where $l_e$ is the effective electrical length, $l_p$ is the actual physical length, and $\in_{eff}$ is the dielectric constant ($\in_r$) of the dielectric material containing the transmission line. By using meanderline structures, smaller antenna elements can be employed to form an antenna having, for example, quarter-wavelength properties.

A schematic representation of a prior art meanderline-loaded antenna 10, is shown in a perspective view in FIG. 1. This embodiment of a meanderline-loaded antenna 10 comprises two spaced-apart vertical conductors 12, a horizontal conductor 14 spanning the distance between the two vertical conductors 12, and a ground plane 16. The vertical conductors 12 are physically separated from the horizontal conductor 14 by gaps 18, but are electrically connected to the horizontal conductor 14 by two meanderline couplers, (not shown), one meanderline coupler for each of the gaps 18, to thereby form an antenna structure capable of radiating and receiving RF (radio frequency) energy.

The meanderline couplers (also referred to as slow wave structures) electrically bridge the gaps 18 and, in one embodiment, have controllably adjustable lengths for changing the performance characteristics of the meanderline-loaded antenna 10. In one embodiment of a meanderline coupler, segments of the meanderline transmission line can be switched in or out of the circuit with negligible loss, to change the effective electrical length of the meanderline coupler, thereby changing the effective antenna length and thus the antenna performance characteristics. The switching devices can be located in high impedance sections of the meanderline transmission line, to minimize current through the switching devices, limiting dissipation losses and maintaining the antenna efficiency.

Like all antennas, the operational parameters of the meanderline-loaded antenna 10 are affected by the wavelength of the input signal (i.e., the signal to be transmitted by the antenna) relative to the antenna effective electrical length (i.e., the sum of the meanderline coupler lengths plus the antenna element lengths). According to the antenna reciprocity theorem, the antenna operational parameters are also equally affected by the received signal frequency. Two of the various modes in which the antenna can operate are discussed below.

FIG. 2 shows a perspective view of a meanderline coupler 20 constructed for use with the meanderline-loaded antenna 10 of FIG. 1. Two meanderline couplers 20 are generally used with the meanderline-loaded antenna 10; one meanderline coupler 20 bridging each of the gaps 18 illustrated in FIG. 1. However, it is not necessary for the two meanderline couplers to have the same physical (or electrical) length.

The meanderline coupler 20 of FIG. 2 is a slow wave meanderline element (or variable impedance transmission line) constructed in the form of a folded transmission line 22 mounted on a dielectric substrate 24, which is in turn mounted on a plate 25. In one embodiment, the transmission line 22 is constructed from microstrip transmission line elements. Sections 26 are mounted close to the substrate 24; sections 27 are spaced apart from the substrate 24. In one embodiment, as shown, the sections 28 connecting the sections 26 and 27 are mounted orthogonal to the substrate 24. The distance between the alternating sections 26 and 27 and the substrate 24 gives the sections 26 and 27 different impedance.

As shown in FIG. 2, each of the sections 27 is approximately the same distance above the substrate 24. However, those skilled in the art recognize that this is not a requirement for the meanderline coupler 20. Instead, the various sections 27 can be located at different distances above the substrate 24. Such modifications change the electrical characteristics of the coupler 20 from the embodiment employing uniform distances. As a result, the characteristics of the antenna employing the coupler 20 are also changed. The impedance (and thus the effective electrical length) presented by the meanderline coupler 20 can also be changed by changing the material or thickness of the microstrip substrate or by changing the width of the sections 26, 27 or 28. In any case, the meanderline coupler 20 must present a controlled (but controllably variable if the embodiment so requires) impedance.

The sections 26 are relatively close to the substrate 24 (and thus the plate 25) to create a lower characteristic impedance. The sections 27 are a controlled distance from the substrate 24, wherein the distance determines the characteristic impedance and frequency characteristics of the section 27 in conjunction with the other physical characteristics of the folded transmission line 22.

The meanderline coupler 20 includes terminals 40 and 42 for connection to the elements of the meanderline-loaded antenna 10. Specifically, FIG. 3 illustrates two meanderline couplers 20, one affixed to each of the vertical conductors 12 such that the vertical conductor 12 serves as the plate 25 from FIG. 2, forming a meanderline-loaded antenna 50. One of the terminals shown in FIG. 2, for instance the terminal 40, is connected to the horizontal conductor 14 and the terminal 42 is connected to the vertical conductor 12. The second of the two meanderline couplers 20 illustrated in FIG. 3 is configured in a similar manner.

The operating mode of the meanderline-loaded antenna 50 (see FIG. 3) depends upon the relationship between the operating frequency and the effective electrical length of the antenna, including the meanderline couplers 20. Thus the meanderline-loaded antenna 50, like all antennas, exhibits operational characteristics as determined by the ratio between the effective electrical length and the transmit signal frequency in the transmitting mode or the received frequency in the receiving mode. Different operating frequencies will excite the antenna so that it exhibits different operational characteristics, including different antenna radiation patterns. For example, a long wire antenna may exhibit the characteristics of a quarter wavelength monopole at a first frequency and exhibit the characteristics of a full-wavelength dipole at a frequency of twice the first frequency.

FIGS. 4 and 5 depict the current distribution (FIG. 4) and the antenna electric field radiation pattern (FIG. 5) for the meanderline-loaded antenna 50 operating in a monopole or half wavelength mode as driven by an input signal source 44. That is, in this mode, at a frequency of between approximately 800 and 900 MHz, the effective electrical length of the meanderline couplers 20, the horizontal conductor 14 and the vertical conductors 12 is chosen such that the horizontal conductor 14 has a current null near the center and current maxima at each edge. As a result, a substantial amount of radiation is emitted from the vertical conductors 12, and little radiation is emitted from the horizontal conductor 14. The resulting field pattern has the familiar omnidirectional donut shape as shown in FIG. 5.

A second exemplary operational mode for the meanderline-loaded antenna 50 is illustrated in FIGS. 6 and 7. This mode is the so-called loop mode, operative when the ground plane 16 is electrically large compared to the effective length of the antenna. In this mode the current maximum occurs approximately at the center of the horizontal conductor 14 (see FIG. 6) resulting in an electric field radiation pattern as illustrated in FIG. 7. The antenna characteristics displayed in FIGS. 6 and 7 are based on an antenna of the same effective electrical length (including the length of the meanderline couplers 20) as the antenna depicted in FIGS. 4 and 5. Thus, at a frequency of approximately 800 to 900 MHz, the antenna displays the characteristics of FIGS. 4 and 5, and for a signal frequency of approximately 1.5 GHz, the same antenna displays the characteristics of FIGS. 6 and 7. By changing the antenna element electrical lengths, monopole and loop characteristics can be attained at other frequencies.

Generally, the meanderline loaded antenna exhibits monopole-like characteristics at a first frequency and loop-like characteristics at a second frequency where there is a loose relationship between the two frequencies, however, the relationship is not necessarily a harmonic relationship. A meanderline-loaded antenna constructed according to FIG. 1 and as further described herein below, exhibits both monopole and loop mode characteristics, while typically most prior art antennae operate in only a loop mode or in monopole mode. That is, if the antenna is in the form of a loop, then it exhibits a loop pattern only. If the antenna has a monopole geometry, then only a monopole pattern can be produced. In contrast, a meanderline-loaded antenna according to the teachings of the present invention exhibits both monopole and loop characteristics.

One important antenna operational parameter is the antenna input impedance, comprising resistive and reactive components that are presented at the antenna input terminals. The resistive component results from antenna radiation and ohmic losses. The reactive component stores energy within the antenna. It is desirable for the resistive component to be constant at the antenna resonant frequency and to have a moderate value, e.g., 50 ohms, at this frequency. The magnitude of the reactive component should be small, ideally zero, to limit the energy stored in the antenna. For an antenna operative over a band of frequencies or at several disparate frequencies, it is desired that the input impedance be about 50 ohms over the frequency range of interest and for the reactive component to be minimal over this same range. The 50 ohm value is conventional in the art, as explained below.

Connecting an antenna to other communications components presents several physical and electrical interface challenges, whether the antenna is operative with spatially proximate communications components such as in a portable communications device, or physically distant from these components such as when mounted on an antenna mast above the earth's surface. For effective operation of the antenna and the communications device, these challenges must be resolved.

In any antenna installation, when operating in a receiving mode, an antenna 70 is typically connected to a filter 72 by a transmission line 73. See FIG. 8. The received signal is filtered to remove unwanted frequency signals received by the antenna 70. Since the received signal is relatively weak, the filtered signal is amplified in an amplifier 74 prior to processing through other components that extract information carried by the received signal.

In the transmitting mode, the antenna 70 is connected to a power amplifier 78 (via a transmission line 79) for boosting the signal strength prior to radiation from the antenna 70. See FIG. 9.

As mentioned above, to minimize electrical losses, it is known to match an output impedance of the filter 72 to an input impedance of a the transmission line 73 (typically 50 ohms), and to match an output impedance of the transmission line 73 (again 50 ohms) to an antenna input impedance. The matching is accomplished by one or both of a matching network 80 associated with the filter 72 and a matching network 82 associated with the antenna 70. Although exact impedance matching of such components is academically desired, pragmatically it is known that two components can be considered to be matched if the impedance values are within a range of about 25% to 50% of either impedance value.

A filter, such as the filter 72, often possesses a negative or capacitive reactance at its output terminals, whereas an antenna (for instance, a loop antenna) may present an inductive or positive reactance at its input terminals. When the filter 72 and the antenna 70 are physically separated and connected with the transmission line 73, as in FIG. 8, the antenna positive input reactance must be matched, using the matching components 82, to a 50 ohm real load presented by the transmission line 73. This is accomplished by configuring the matching components 82 to present a conjugate impedance relative to the antenna impedance. Such a match provides maximum power transfer and efficiency between the antenna 70 and the transmission line 72.

Likewise, the filter 72 requires the matching components 80 to present a conjugate match to the transmission line 73, while transforming the real part of the impedance to 50 ohms to match the transmission line impedance. Effecting these two impedance matching requirements permits maximally efficient operation of the filter 72 and antenna 70 with the intervening transmission line 73. The matching components 80 and 82 can be connected at any point or break in the transmission line 73. Unfortunately, the added matching components add cost and additional power loss, resulting in unrecoverable signal losses to heat in the matching components.

Similarly, a power amplifier output impedance is matched to the antenna input impedance through a matching network 84 or the matching network 82. Certain power amplifiers (also referred to as RF (radio frequency) amplifiers since they operate on RF signals) are comprised of a differential output transistor pair. Thus the output signal from these amplifiers must be converted to a single ended drive to interface with the 50-ohm transmission line 79, which in turn connects to the antenna 70. A balun is a device that can be used to convert from a differential output to a single-ended output.

In the industry there is an historical reliance on a 50-ohm impedance match between the antenna and other front end components (e.g., filter, amplifier). The historical importance of the 50-ohm impedance match is predicated on the impedance characteristics of certain transmission lines comprising dielectric materials and two electrical conductors arranged in coaxial geometry. The transmission lines are designed to minimize losses over long distances. For this geometry, the optimal transmission line impedance is calculated to be in the range of 50 to 75 ohms. Thus this value has defined the 50 ohm impedance matching between the antenna and other font end components when connected by a transmission line.

Since small portable devices rely on very short transmission lines due to the proximity of the antenna and the front end components, there is no need to require the standard impedance of 50 ohms between these elements. There are also advantages to be gained, i.e., minimizing losses, by avoiding the impedance transformation from the amplifier output stage to 50 ohms and then reconversion from 50 ohms to the antenna impedance at resonance, which is often less than 50 ohms. It is therefore advisable to connect the antenna to the amplifier or the filter through an impedance matching element of other than 50 ohms.

In addition to the electrical impedance matching, physical interface issues are important whenever an antenna is installed proximate other components of the communications device. It is necessary to properly interface the device elements to limit deleterious component interactions. The transmission line connecting the components must be properly routed, and there are also component shielding issues to consider. These design concerns add cost and complexity to the design process, and also to the cost of debugging the device to resolve problems caused by unexpected component interactions.

The same issues of physical and electrical interfacing are present in radio frequency transmitting and receiving installations utilizing a mast-based antenna connected via a transmission line to ground-based receiving and transmitting components typically housed in a shelter, enclosure or cabinet at the base of the antenna mast or tower. Such installations are used for long distance communications. Antennas for several different wireless services or antennas operating at different frequencies for the same wireless service, frequently share the antenna mast. With the proliferation of wireless devices and the base station antennas to service them, and the attendant crowding of the RF spectrum, co-interference caused by spatially close wireless service antennas operating at adjacent or nearby spectral frequencies is an increasingly serious problem.

At mast sites, or any site where radio services are co-located, the conventional technique for reducing interference is through the use of in-line filters providing any of the known filter functions, such as low pass, high pass, band-pass, band reject, notch, diplex or duplex. These filters are generally purchased from suppliers other than the antenna supplier and thus must be mechanically fitted to and electrically matched (i.e., impedance matched) to the transmission line characteristics and to the antenna. The filters are typically co-located with the receiver/transmitter equipment or disposed in-line, that is, within the transmission line. The filter can be tunable under control of the receiver/transmitter such that as the receiver or transmitter is tuned, the appropriate frequency components are passed or blocked by the filter. Whether located in-line or with the receiver/transmitter, additional space is required to accommodate the filters. In the latter situation, space must be made available at the base of the tower, where it is at a premium. In-line filters require special cables and connectors to connect the filter into the transmission line. These connectors can become a source of interfering radiation for other nearby transmitting and receiving devices. Signal leakage is especially prevalent at the cable connectors and increases as the cable deteriorates due to water intrusion and other weathering effects.

To further reduce interference, high isolation transmission lines are employed between the antenna at the top of the mast and the receiving/transmitting equipment at ground level. The transmission lines, which are by necessity expensive and bulky to achieve the required high-isolation properties, are designed to prevent the unintended reception of interfering signals from nearby transmitting antennas and nearby leaking transmission lines. The high-isolation lines are also designed to limit the outgoing RF' leakage that may cause problem for adjacent transmission lines and receiving/transmitting equipment.

The transmission lines themselves are also problematic as water leakage, physical damage (e.g. gouging or denting of the cable) or loose connectors between line segments can change the transmission line impedance and thereby affect the line's performance. At an exemplary antenna tower, it is determined that the transmission line between the tower and the receiver/transmitter is particularly susceptible to interference from another antenna mounted on the tower and operating at a frequency f. To remedy this situation, a notch filter is installed in the transmission line. The installation requires opening the high-isolation transmission line and installing the notch filter to attenuate the troublesome signal. High isolation connectors are required for this installation, and upon completion, the system performance must be tested, as it is known that the installation of filters may disrupt and modify the transmission line characteristics and thus the performance of the entire system.

Antennas employed in these wireless applications as mounted on towers and masts include any of the well known antenna types: half-wave dipoles, loops, horns, patches, parabolic dishes, etc. The antenna selected for any given application is dependent on the requirements of the system, as each antenna offers different operational characteristics, including: radiation pattern, efficiency, polarization, input impedance, radiation resistance, gain, directivity, etc. A meanderline-loaded antenna can also be used in these installations.

SUMMARY OF THE INVENTION

The present invention comprises an apparatus for receiving radio frequency signals, comprising an antenna having an input reactance and a filter having an output reactance. The input reactance and the output reactance are opposite in sign and substantially equal in magnitude.

BRIEF DESCRIPTION OF THE DRAWINGS

The features of the antenna constructed according to the teachings of the present invention will be apparent from the following more particular description of the invention, as illustrated in the accompanying drawings, in which like reference characters refer to the same parts throughout the different figures. The drawings are not necessarily to scale, emphasis instead being placed upon illustrating the principles of the invention.

DETAILED DESCRIPTION OF THE INVENTION

Before describing in detail the particular antenna and associated communications components in accordance with the present invention, it should be observed that the present invention resides primarily in a novel and non-obvious combination of elements. So as not to obscure the disclosure with details that will be readily apparent to those skilled in the art, certain conventional elements and steps have been described and illustrated with lesser detail, while other elements and steps pertinent to understanding the invention have been described and illustrated in greater detail.

Integration of the antenna with certain front-end components as taught by the present invention can provide advantages in both amplifier power efficiency and antenna performance. Integration can also provide a cost advantage during product design and test due to elimination of certain component placement and interaction issues. The integration can include the antenna and the filter (in the receiving mode) and/or the antenna and the power amplifier (in the transmitting mode). It is suspected that integration has heretofore not been undertaken due to the historical reliance on the 50 ohm impedance match described above.

Figure 9:
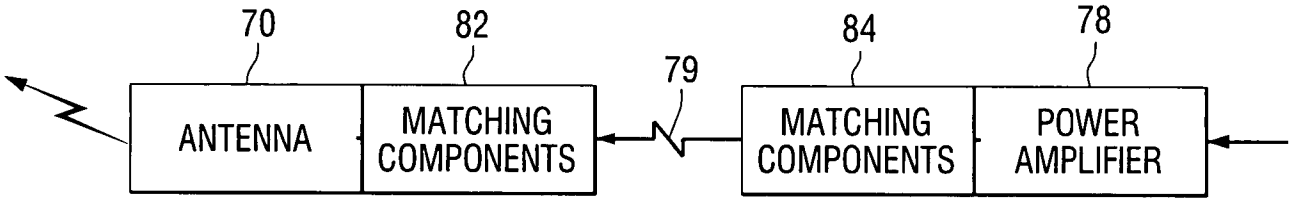
FIG. 9 PRIOR ART
Figure 10:
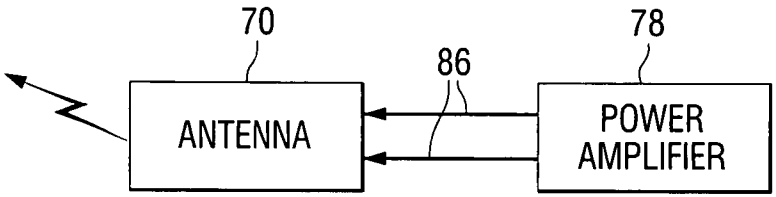
FIGS. 10 and 11 illustrate in schematic form an integrated antenna and associated components according to the teachings of the present invention.

According to one embodiment of the present invention, the antenna 70 is driven differentially from the power amplifier 78 over a differential conductor pair 86 of FIG. 10 for transmitting a signal from the antenna 70. Further, in a preferred embodiment, the antenna 70 and the power amplifier 78 are integrated on a common physical mounting platform. Minimal impedance matching components may be required due to the proximity of the power amplifier 78 and the antenna 70. A conventional power amplifier may have an relatively low output impedance, and certain small antennas exhibit a relatively low input impedance. Thus the need for only minimal matching components. According to the prior art, connection of the power amplifier to the antenna is accomplished through a 50 ohm transmission line. Conversion to a single ended feed (as required by the prior art as illustrated in FIG. 9) with a 50 ohm impedance is also not required. Thus losses added by the matching and conversion components are avoided. In addition, it is know that a differential drive to an antenna has the advantage of producing a symmetric radiation pattern due to the lack of ground-current induced asymmetry in the antenna radiation pattern. Such asymmetry can be produced by the single ended feed of FIG. 9.

Figure 11:
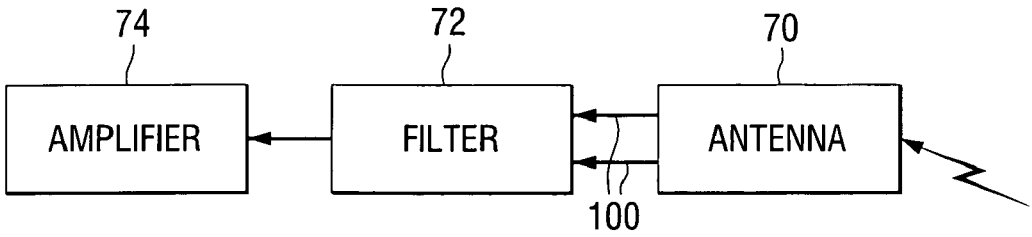

As depicted in FIG. 11, in the receiving mode the filter 72 can be differentially connected to the antenna 70 via conductors 100.

The meanderline antenna 50 described above is one antenna structure that can be beneficially differentially fed according to the teachings of the present invention. Additionally, loop antennas and balanced dipole antennas can benefit from a balanced feed configuration and thus are suited to the approach of the present invention. In an embodiment where one or more of the antenna, filter, power amplifier and matching components are located in close proximity, it may not be necessary to utilize a differentially-fed transmission line, requiring conversion to 50 ohms at both terminal ends of the transmission line. Instead, the components can be differentially connected directly if in close enough proximity, i.e., a feed line is not required. This suggests that in one embodiment, the amplifier, filter, power amplifier and antenna can comprise a module. The module approach provides cost and size advantages over the prior art approach of incorporating individual components into the communications device. In particular, a module consumes less space than individual elements. Also, it is unnecessary for the device designer to layout a transmission line on a printed circuit board to interconnect the elements. Further, with the module, approach, the concerns over shielding, impedance matching and other physical and electrical interface issues are avoided during device design, as they are addressed and resolved in the design and construction of the module.

Figure 12:
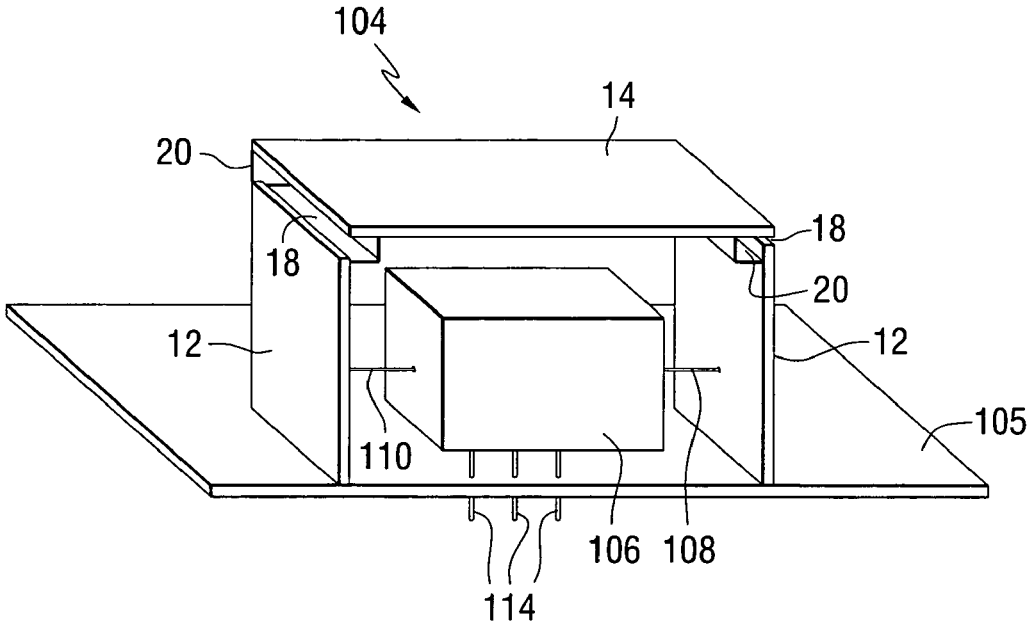
FIGS. 12 and 13 are perspective illustrations of an integrated antenna and associated components according to one embodiment of the present invention.

FIG. 12 illustrates an example of the physical integration of a meanderline antenna 104, with an electronics module 106 comprising, for example, amplifier and filter components and a power amplifier, such as those described above, and other related components, such as signal processing components. The antenna 104 and the electronics module are disposed on a substrate 105. Two differential feed connections 108 and 110 connect the electronics module 106 to the vertical conductors 12 of the meanderline antenna 104. Integration of the electronics module 106 and the meanderline-loaded antenna offer both physical compactness and improved performance. The concepts discussed below, relative to impedance matching of a filter and an antenna, can also be applied to this embodiment of the present invention.

Connecting pins 114 extending from the electronics module 106 through the substrate 105 carry input and output signals between the electronics module 106 and a printed circuit board on which the substrate 105 is mounted in connection with operation in a communications device. In another embodiment, the FIG. 12 components, including the antenna 104, can be disposed within an enclosure and affixed to the communications device as a unitary structure. Electrical connection is provided through the connecting pins 114.

If the antenna 104 is fed in the monopole mode, as described above, an omnidirectional radiation pattern is produced, with minimal radiation emitted in the vertical direction perpendicular to the top plate 14. The antenna 104 is operative with or without a ground plane. In the latter embodiment, a ground plane (not shown) is disposed on the substrate 105.

It is known that meanderline antennas, including the meanderline antenna 104 as illustrated in FIG. 12 exhibits an impedance of about 50 ohms. It is further known that certain power amplifiers exhibit an output impedance of about 50 ohms. Thus according to the teachings of the present invention, such an antenna and power amplifier can be advantageously connected without the need for impedance matching components.

In one embodiment, the electronics module 106 provides transmitting and receiving capability for a Bluetooth wireless link. It can be appreciated by those skilled in the art that an electronics module can be constructed to operate at any desired frequency and with any desired wireless communications protocol. For example, at an operating frequency of 2450 MHz, the distance between the substrate 105 and the top plate 14 is about 5 mm (assuming a dielectric constant for the substrate material of about 6–8. This distance provides sufficient space for an electronics module carrying the various components as described. At about 1900 MHZ, the distance increases to about 6.2 mm. Those skilled in the art recognize that selection of a substrate material with a higher dielectric constant results in a smaller distance between the top plate 14 and the substrate 105.

Figure 13:
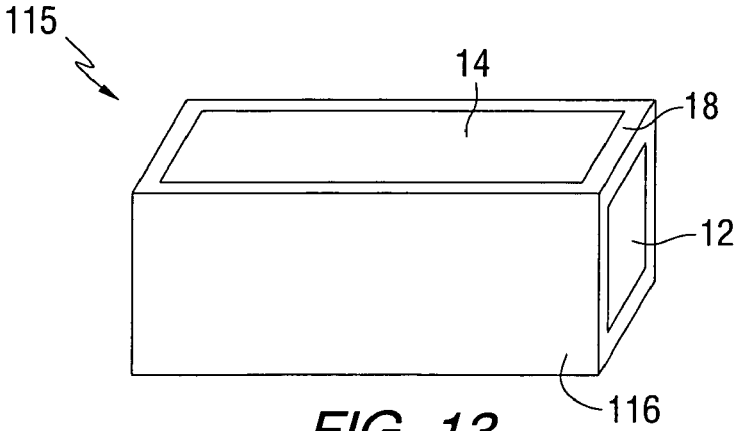

In yet another embodiment illustrated in FIG. 13, an electronics module 115 comprises a substrate 116 further comprising ceramic or another insulating material. Certain of the antenna components, including the vertical conductors 12 and the top plate 14, can be printed or otherwise formed on one or more surfaces of the substrate as illustrated. The meanderline conductor 20 is disposed internal to the module 115 and not shown in FIG. 13. Although a meanderline antenna is illustrated, those skilled in the art recognize that other antenna types can be employed in lieu of the meanderline antenna. For example, in one embodiment a patch antenna can be printed or otherwise formed on the substrate 116. Feed connections for connecting components of the electronics module 115 to the vertical conductors 12 are disposed internal to the electronics module 115 and thus not illustrated in FIG. 13. This embodiment can provide a more compact assembly than the embodiment of FIG. 12.

Figure 14:
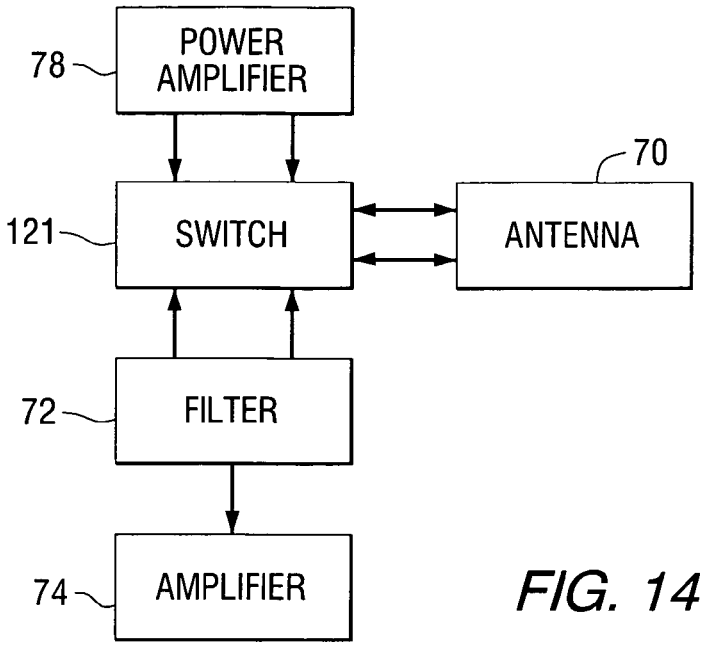
FIGS. 14 and 15 are block diagrams of various embodiments of the present invention.

FIG. 14 illustrates the use of a single antenna 70 for receiving and transmitting signals in a communications device. In the transmitting mode, a switch 121 is positioned to differentially connect the power amplifier 78 to the antenna 70. In the receiving mode, the switch 121 differentially connects the antenna 70 to the filter 72.

Figure 15:
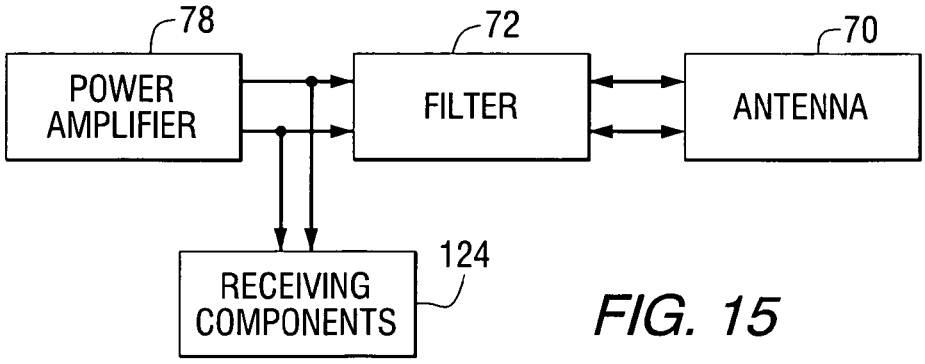

Use of the switch 121 can be avoided, as illustrated in FIG. 15, when the frequency and bandwidth of the signal supplied to the antenna 70 from the power amplifier 78 is within a pass band of the filter 72. Thus the transmitted signal passes through the filter 72 without substantial effect. The received signal is input to receiving components 122 from the filter 72.

Figure 1:
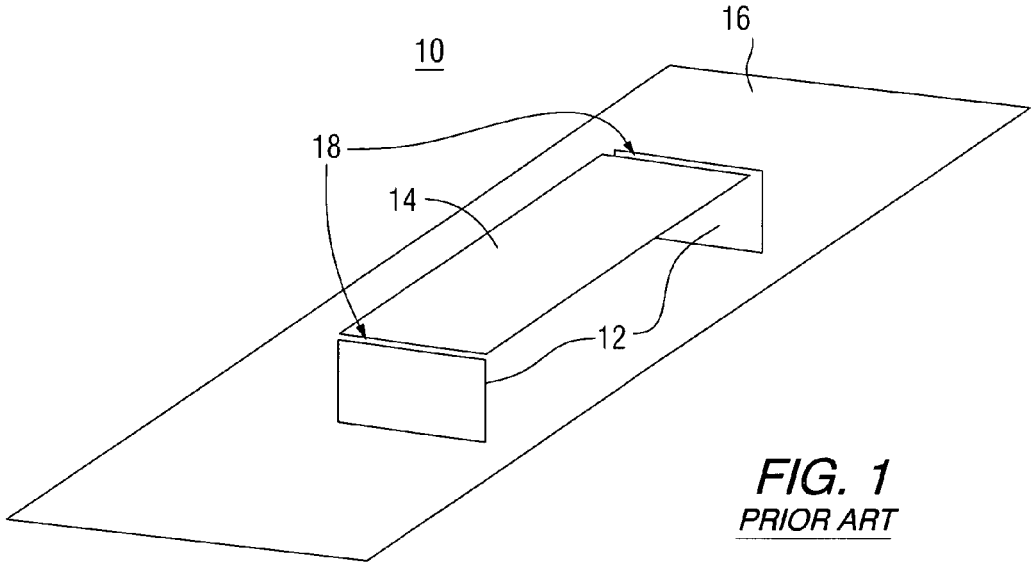
FIG. 1 PRIOR ART
FIG. 1 is a perspective view of a prior art meanderline-loaded antenna.
Figure 2:
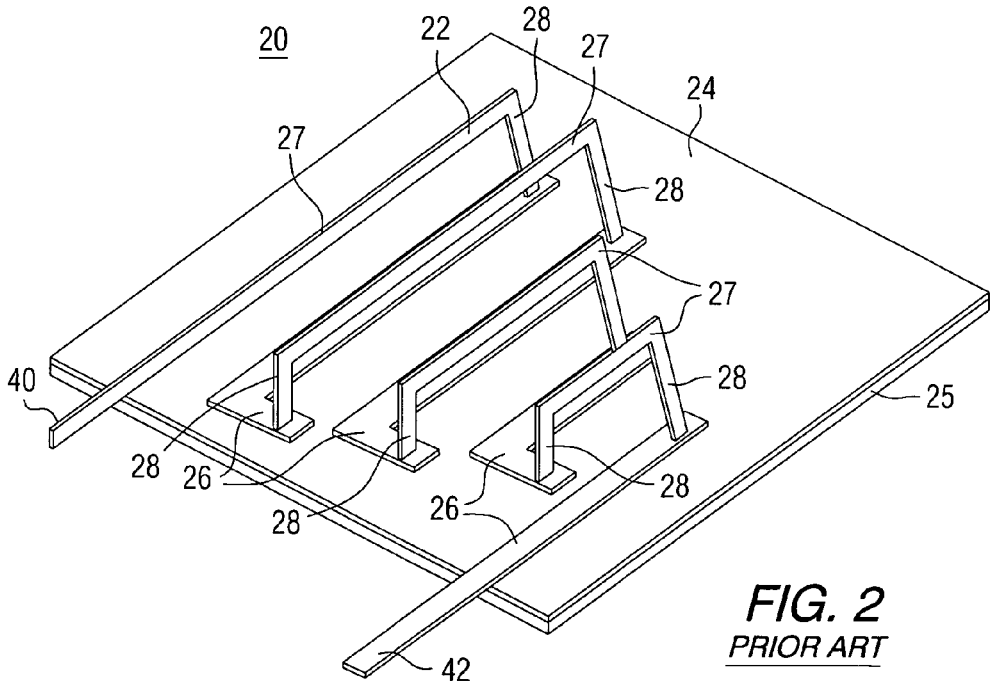
FIG. 2 PRIOR ART
FIG. 2 illustrates a meanderline coupler for use with the meanderline-loaded antenna of FIG. 1.
Figure 3:
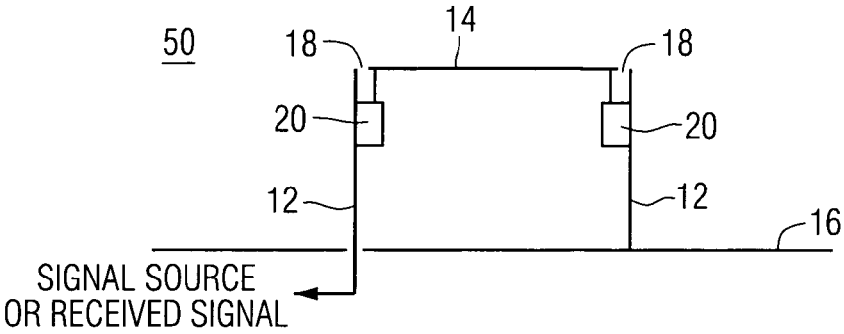
FIG. 3 PRIOR ART
FIG. 3 is another view of a prior art meanderline-loaded antenna.
Figure 4:
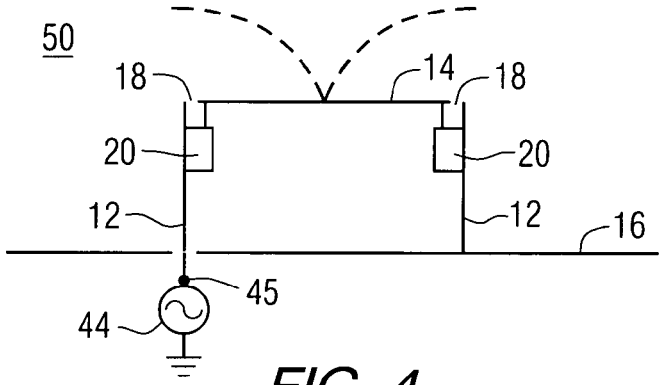
FIG. 4 PRIOR ART
FIGS. 4–7 illustrate the current distribution and the radiation pattern of the prior art meanderline-loaded antenna of FIG. 1.
Figure 5:
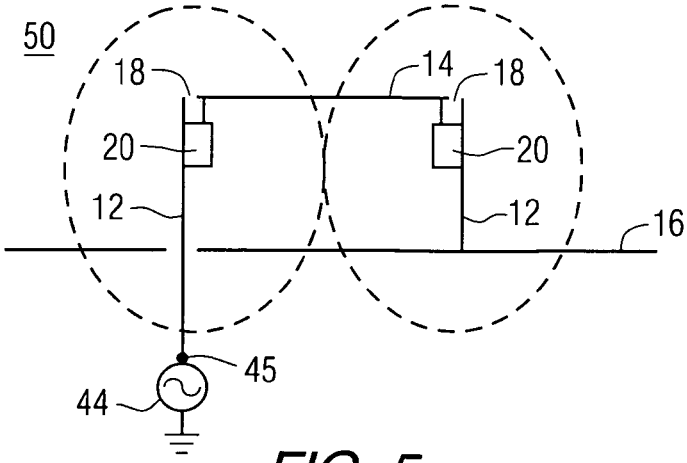
FIG. 5 PRIOR ART
Figure 6:
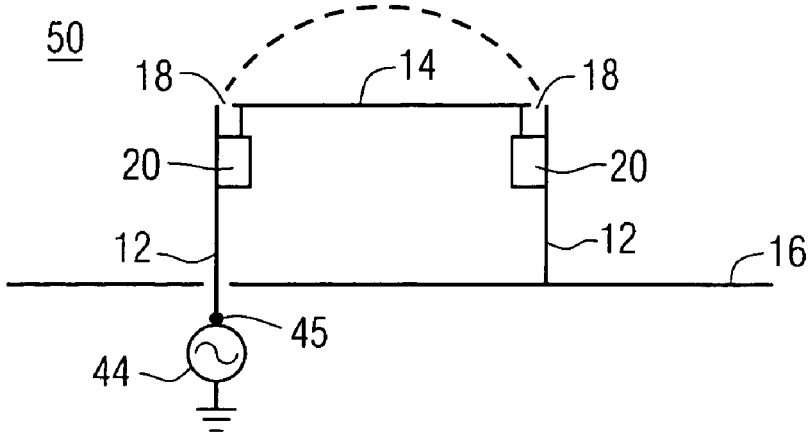
FIG. 6 PRIOR ART
Figure 7:
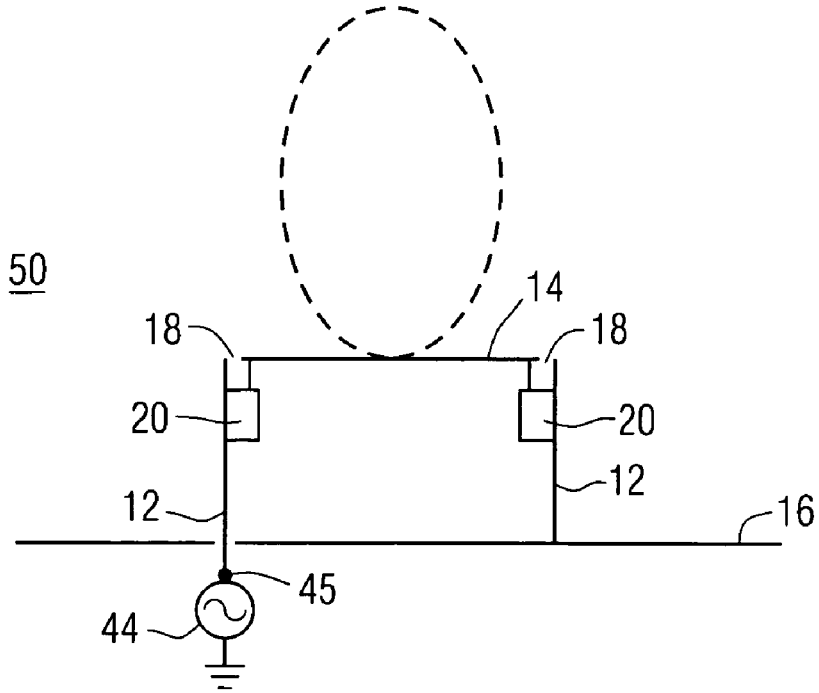
FIG. 7 PRIOR ART
Figure 8:
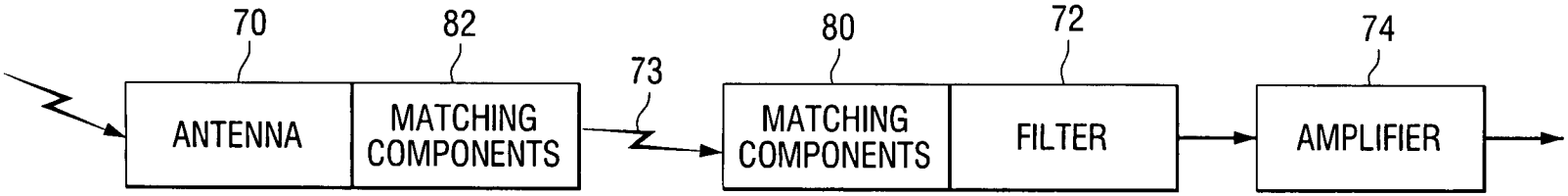
FIG. 8 PRIOR ART
FIGS. 8 and 9 illustrate an antenna and associated components for use in a communications device.

In another embodiment of the present invention, the prior art matching components 80 and 82 of FIGS. 8 and 9 can be avoided by making the antenna reactance (typically inductive) equal in magnitude but opposite in sign to the filter reactance (typically capacitive), thus improving power transfer from the filter to the antenna and the overall power efficiency of the communications device with which the components are operative. In certain applications, the real component of the filter impedance and/or the antenna impedance may be lower than 50 ohms, permitting a direct filter to antenna connection (i.e., without an intervening transmission line and the attendant conversion to a 50 ohm output from the filter and a 50 ohm input to the antenna) when the capacitive and inductive reactances have been cancelled.

Figure 16:
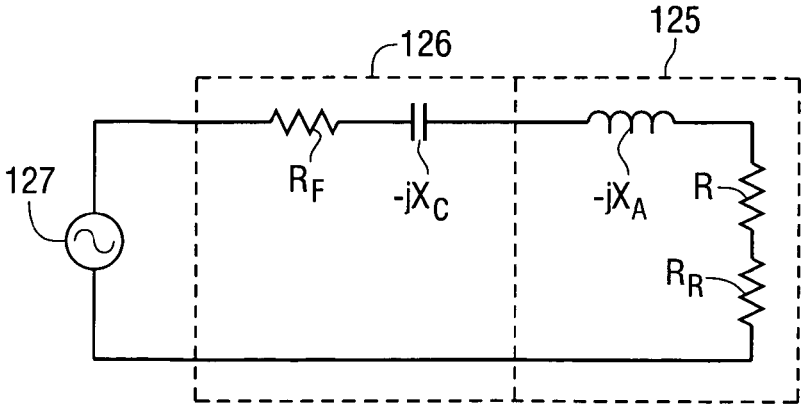
FIGS. 16 and 17 are schematic diagrams illustrating integrated elements according to the teachings of the present invention.

FIG. 16 schematically illustrates the reactance cancellation for an antenna 125 connected to a filter 126. The equivalent electrical circuit of the filter 126 comprises a resistance RF and a reactance $-jX_F$. The filter 126 is driven by a source 127. The equivalent electrical circuit of the antenna 125 comprises a series connection of a reactance $jX_A$, a resistance R and a radiation resistance $R_R$. To avoid use of the impedance matching components of the prior art, the resistance $R_F$ is determined to be approximately equal to a sum of the antenna resistances $R+R_R$. Also, the filter reactance is determined to be approximately equal in magnitude and opposite in sign to the antenna reactance at the resonant frequency or within the operating band of the antenna 125, that is, $jX_F=jX_A$. In this embodiment, the antenna 125 and the filter 126 are preferably collocated to achieve the beneficial reactance cancellation and impedance matching effects. The filter 126 can be embodied as a passive or an active filter, and can be constructed from analog or digital components, including analog to digital conversion components, as determined by the operational frequency and other requirements of the communications device with which it is operative.

Figure 17:
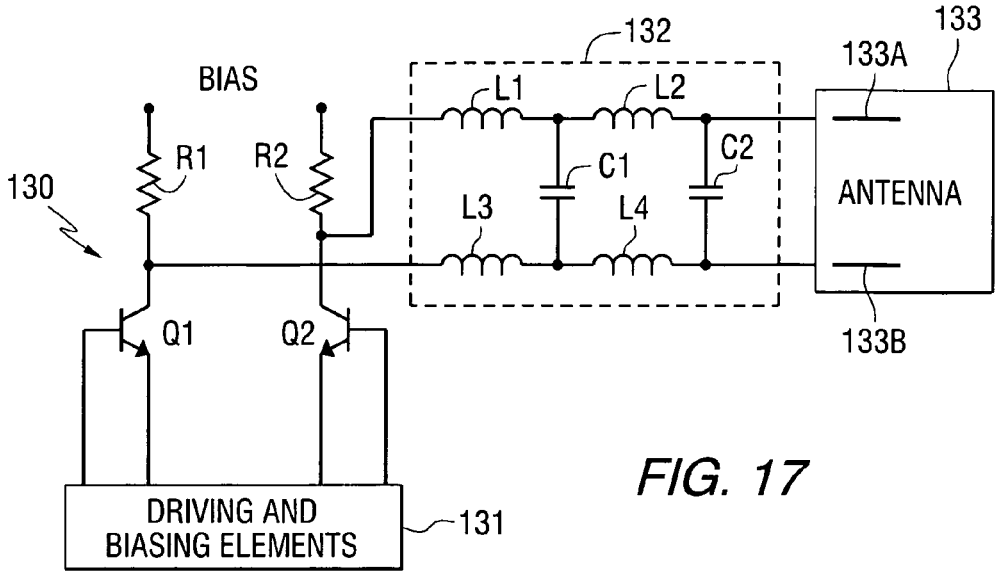

FIG. 17 is a schematic illustration of a differential power amplifier 124, comprising transistors Q1 and Q2 connected in a conventional differential arrangement with resistors R1 and R2, and further connected to driving and biasing elements 131. An exemplary filter 132 comprises inductors L1-L4 and capacitors C1 and C2 connected as shown. An antenna 133 comprises leg elements 133A and 133B for receiving a differential feed from the filter 132. In one embodiment, the antenna 133 comprises the meanderline antenna 50 and the legs 133A and 133B comprise the vertical conductors 12. In one embodiment the filter reactance and the antenna reactance are approximately equal in magnitude and opposite in sign to achieve the beneficial effects of reactance cancellation as described above.

Figure 18:
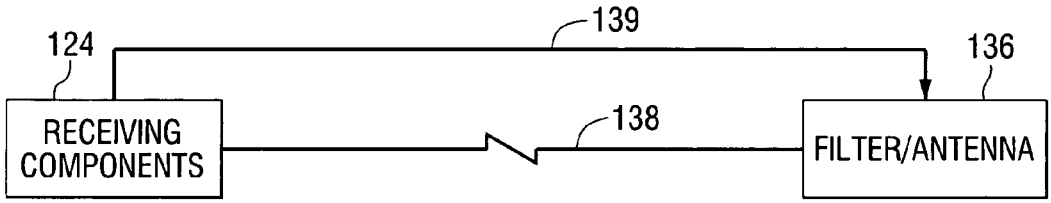
FIGS. 18–19 are block diagrams of various embodiments of the present invention.

FIG. 18 illustrates receiving components 124 connected to an integrated filter/antenna, referred to as an integrated assembly 136, which comprises a filter and antenna exhibiting the reactance canceling properties described above. A transmission line 138 connects the receiving components 124 with the integrated assembly 136.

The integrated assembly 136 is tunable by a control signal on a control line 139 provided by the receiving components 124 (or by transmitting components in the transmitting mode) for adjusting the filter characteristics, including center frequency, bandwidth and the filter skirt roll-off (i.e., the slope of the lines defining the edges of the filter's pass band or reject band). The integrated assembly 136 can be manufactured and sold as a standard product, requiring only an impedance match to the transmission line 138. Additional filter design flexibility is provided by avoiding the requirement of matching the filter output impedance to the antenna input impedance as that impedance match is made when the integrated assembly is designed and fabricated. Also, concurrent design of the antenna and the filter as an integrated assembly allows the design of both to be optimized.

Figure 19:
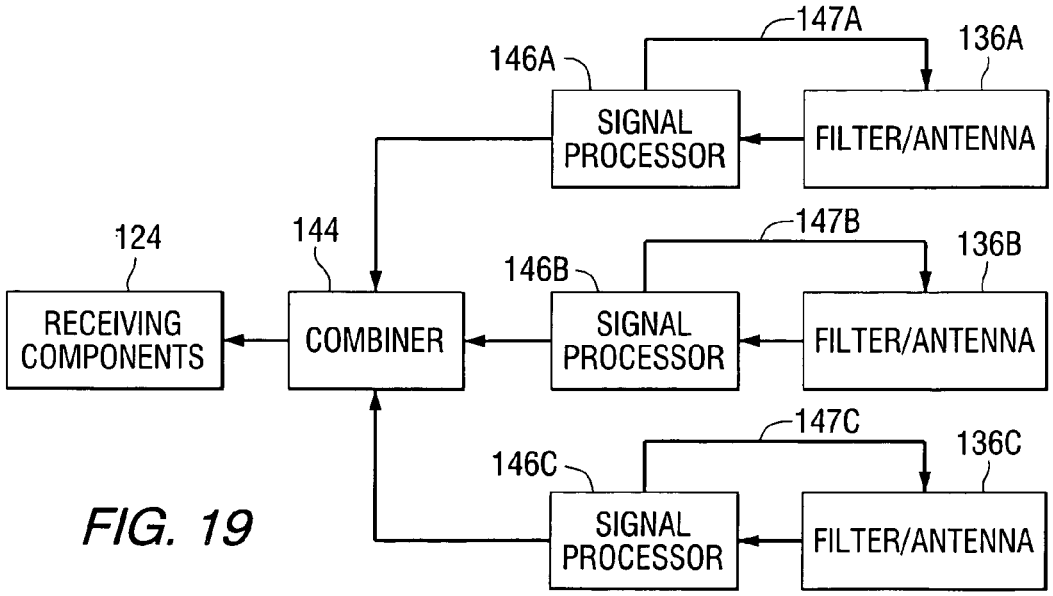

FIG. 19 illustrates an antenna array, comprising integrated assemblies 136A–136C for receiving signals that are combined in a combiner 144. The combined signal is input to the receiving components 124. In one application each of the array of integrated assemblies 136A–136C (in one embodiment comprised of the meanderline-loaded antenna 50 and a filter 72) is operative with one of a plurality of signal processors 146A–146C. According to this application, signal processing of the received signal is advantageously carried out proximate each antenna element, i.e., in this application at each integrated assembly 136A–136C under control of the signal processors 146A–146C.

It is known that the propagation environment between the transmitter and the array of filters/antennas 136A–136C may cause scattering and mixing of the transmitted signal. Thus the phase and amplitude of the signal received at each of the array antenna elements will vary due to coherent cancellation along the propagation path. To enhance received signal detection, it may therefore be advisable to apply unique phase and/or amplitude weights to each received signal before combining. The weights are determined and applied by the signal processors 146A–146C. This technique provides dynamic frequency agility for the antenna by permitting the signal received at each filter/antenna 136A–136C to be processed separately for phase and amplitude combining and selecting. Such is the case with multiple input/multiple output (MIMO) antenna arrays that are commonly used for wireless networks having a relatively small coverage zone surrounding a base station. Such piconets are especially common in urban environments where multiple piconets are constructed to provide coverage in the high scattering environment.

Figure 20:
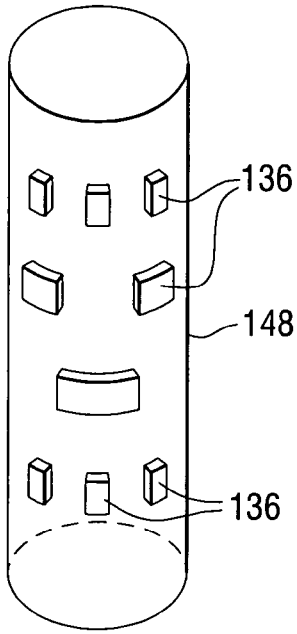
FIG. 20 illustrates an antenna sleeve for supporting an integrated filter/antenna of the present invention.

This technique also allows one array to provide shared services operating in different frequency bands. For example, one region of the array can operate at a first frequency and a second region of the array can operate at a second frequency. Integration of the filter and the antenna, as in the integrated assemblies 136A–136C, avoids the conventional interconnecting coaxial cable between these elements, allowing the antenna array to be implemented with appropriate spacing between antenna elements. Appropriate element spacing cannot be practically achieved when bulky transmission line cables must be accommodated between antenna elements. In a piconet installation (also known as a picocell when referring to a cellular telephone service), multiple integrated filters/antennas are mounted on an antenna sleeve 148 of FIG. 20. In one embodiment, the antenna comprising the integrated filter/antenna assembly is a meanderline antenna such as the meanderline antenna 50 operative in conjunction with a ground plane provided by the sleeve 148. Use of the integrated filter/antenna provides a controllable signal path from each antenna, thus permitting independent signal processing for each of the antenna signals, as described above. In one embodiment, the antenna elements of the integrated filter/antennas are disposed in alternating horizontal and vertically orientations to produce alternating horizontally and vertically polarized signals. That is, the first antenna row is disposed horizontally to emit a horizontally polarized signal in the transmit mode and to most efficiently receive a horizontally-polarized signal in the receive mode. The second antenna row is disposed vertically to emit or receive vertically polarized signals.

With the integrated approach of the present invention, the filter and the element can be conveniently installed in the interior of the sleeve, without the use of interconnecting transmission lines and the problems attendant thereto. The output signal from the integrated assembly comprises a base band signal that is processed by components that are outside the antenna sleeve. Processing at the radio frequency of the received signal can be accomplished by adding signal processing components to the integrated filter antenna element assembly. To permit transmitting through the filter/element assembly, it may be necessary to dynamically control the pass band of the filter such that the transmitted signal frequency and signal bandwidth is within that pass band. Alternatively, a separate transmit antenna element can be used.

Further, in connection with the unique processing for each received signal, it may also be preferable to adjust the spectral filtering provided by the filters/antennas 136A–136C using a control signal provided to the filters/antennas 136A–136C via conductors 147A–147C. Since the function of the signal processors 146A–146C may be filtering at base band or at the carrier frequency, down conversion, decoding, etc., it is preferable for the filter function to be integral to the antenna and processor. The filtering process can be carried out in the analog or digital domain.

In addition to the described signal processing aspects, the use of an adaptable integrated filter/antenna permits certain elements in array, e.g. elements that are receiving a weak signal, to be reused by shifting their operation to a different frequency. The integrated filter/antenna can be adaptively tuned in real-time to meet the demands of multiple communications systems operating concurrently from the same antenna array. For example the teachings of the invention could be used to allow a base station antenna array to be frequency adaptive for a multiple communications systems using the same array.

Figure 21:
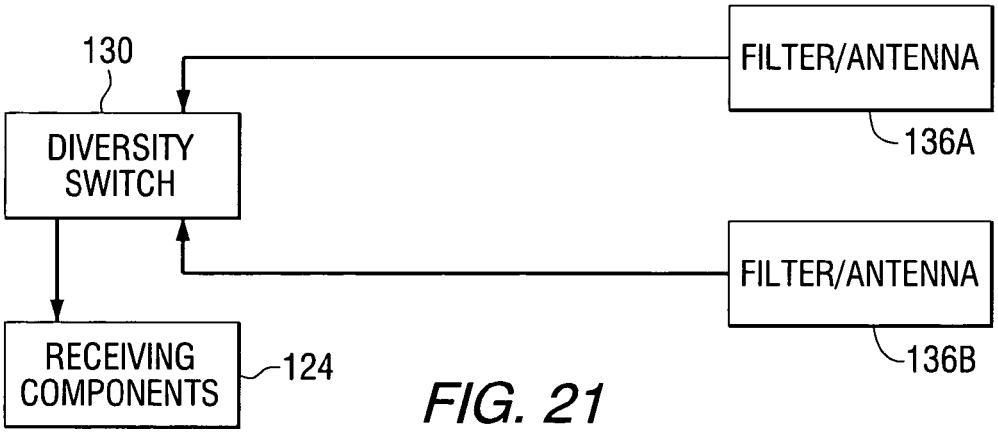
FIG. 21 is a block diagram of a antenna diversity apparatus according to the present invention.

Although illustrated for use with an antenna array in FIG. 19, the teachings can also be applied to a diversity antenna system, i.e., an antenna system comprising two or more filters/antennas 136A and 136B for independently receiving a signal. The two received signals are analyzed according to predetermined signal quality metrics, and the signal displaying the better metrics is supplied to the receiving components 124. Such a diversity system is illustrated in FIG. 21 comprising a diversity switch 150 for performing the signal quality metric analysis and providing the signal displaying the better metrics to the receiving components 124.

Figure 22:
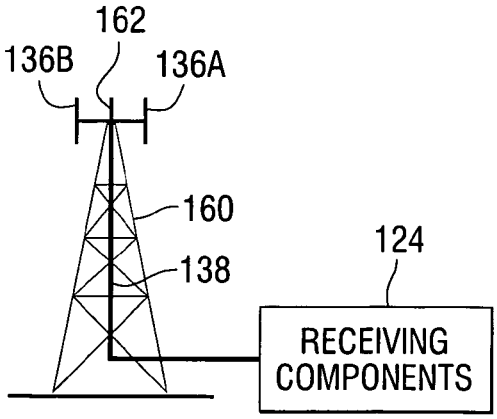
FIGS. 22 and 23 illustrate embodiments of the invention wherein certain components are installed on an antenna mast.

In one embodiment of the present invention, applicable to both the single antenna and antenna array embodiments, the integrated assembly 136A and 136B are located at the top of a mast or tower 160 and the receiving components 124 are located in an enclosure or shelter at the base of the tower or mast 160. See FIG. 22. Further, according to the teachings of the present invention, contrary to the prior art, it is not required that the transmission line 138 comprise a high-isolation transmission line, since the filter within the integrated assembly 136 attenuates spurious emissions induced in the transmission line 138 by nearby antennas, for example by an antenna 162 also located on the tower or mast 160.

Figure 23:
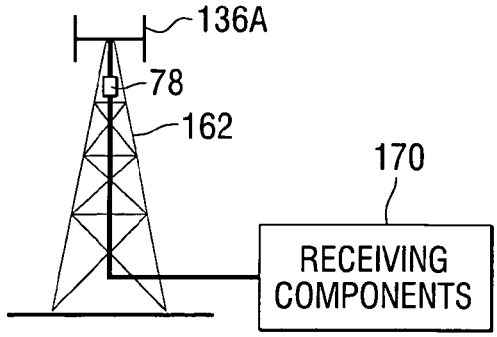

In another embodiment, placement of the power amplifier 78 (or a plurality of such power amplifiers in an antenna array embodiment) at the top of the mast 160 proximate the integrated assembly 136, reduces signal power losses that according to the prior art are experienced along the prior art coaxial cables extending between transmitting components 170 and the integrated assembly 136. See FIG. 23. The power supplied to each integrated assembly 136 is independently controlled by controlling the power amplifier 78 associated with the integrated assembly 136, offering improved efficiency and reliability.

According to the prior art, high-power transmitting antennas use a feed line to connect the mast-based antenna to the ground-based power amplifier. The feed line exhibits a characteristic impedance that is selected to minimize loss for transmission over relatively large distances. According to the present invention, the power 78 amplifier and the integrated assembly 136 are collocated at the top of the mast 170. Instead of providing high power transmission signals to the power amplifier 78, exciter or excitation signals are supplied from the ground. The excitation signals have a lower power level than the transmission signals and can therefore be transmitted by optical means, such as via fiber optic cable or optical waveguide. Thus losses in the prior art copper transmission line are avoided, and less input power is required due to reduced power losses in the optically-based feed line.

When used in an array embodiment, the technique is also advantageous since each antenna array element can be driven by a dedicated power amplifier having a lower output power rating than the power amplifiers used in the prior art to drive all elements of the array. As is known in the art, a lower rated power amplifier is generally more efficient and available at a lower cost than a high-power rated version. The power rating of each amplifier, Pi, can be reduced by the number of elements in the array N to Pi=P/N, where P is the total array power. Several system level advantages are obtained by using individual power amplifiers. The array is less susceptible to a complete outage, and thus a shutdown of the communications system operative with the array, due to a main power amplifier failure. Array reliability is improved and operational redundancy is provided. Inoperative array elements (i.e., integrated filters/antennas) are removed from service with only marginal impact to array operation. The system power efficiency is improved due to inherent efficiency advantage of several smaller power amplifier over a single large amplifier. Relatively low power amplifiers have a lower cost than high power units.

With the power amplifier integrated with the antenna, a transmission line capable of providing a high power signal output from the power amplifier to the antenna is not required. Instead, a fiber optic cable can be used to supply the excitation signal to the power amplifier. There are additional advantages to be gained from the use of a fiber optic cable, applicable to both the single antenna and the antenna array embodiment of the present invention. A fiber optic cable provides immunity to radio frequency interference from nearby radiators, both intentional and unintentional radiators. When operative in the receiving mode, even when high isolation transmission lines are used according to the prior art, interference can be induced into the high isolation line (for example, at the point where connectors attach in-line filters to the transmission line) and then presented to the receiver input stage. The use of a fiber optic transmission line eliminates this interference. Losses in the fiber optic cable are also lower than losses experienced in coaxial cable. Therefore the output power of the transmitter can be reduced in the transmitting mode and the signal power presented to the receiver is increased in the receiving mode. Further, the fiber optic cable does not leak radio frequency energy that can cause interference problems at nearby transmitting and receiving equipment. The RF electrical isolation afforded by the fiber optic cable also inherently provides the additional advantage of reducing disruptions caused by lightning strikes at the tower or mast, especially if the communications system is battery-powered.

For those installations using a fiber optic cable and requiring the provision of electrical power from the base of the mast 160 to the power amplifier 78 (or the other elements of the integrated assembly 136), the can be provided as DC or AC power over a separate power cable from the base of the tower or mast 160.

As applied to the antenna array embodiment discussed above, a separate fiber optic cable can service each integrated assembly 136 of the array and thereby provide signals of different amplitude and phase to each element to effect beam steering. Alternatively, signal multiplexing (for example, wavelength division multiplexing) can be used to drive each integrated assembly 136 from a single fiber optic cable.

In another embodiment where the transmission line 138 is not a fiber optic cable, the filter within the integrated assembly 136 attenuates out-of-band frequency components that may be induced in the transmission line 138, preventing transmission of such components by the antenna of the integrated assembly 136. Such interfering signals can be induced in the transmission line 138 at connector joints, for example. It is known that even such out-of-band frequency components in the transmitted signal can degrade performance at the received in-band frequencies, due to the effect of these out-of-band signals on receiver sensitivity. To filter the out-of-band components, the filter comprises a band pass filter with the pass band defined by the transmitted signal spectrum such that the out-of-band components are attenuated. In another example, the filter comprises the same band pass filter with the addition of a notch at the frequency of a nearby emitter, or at the frequency of an intermodulation product formed in the transmission line 138.

With the filter integrated with the antenna, a high isolation transmission line is not required since the filter attenuates the out of band signals. Thus a less expensive transmission line can be used in lieu of the prior art high isolation lines.

Figure 24:
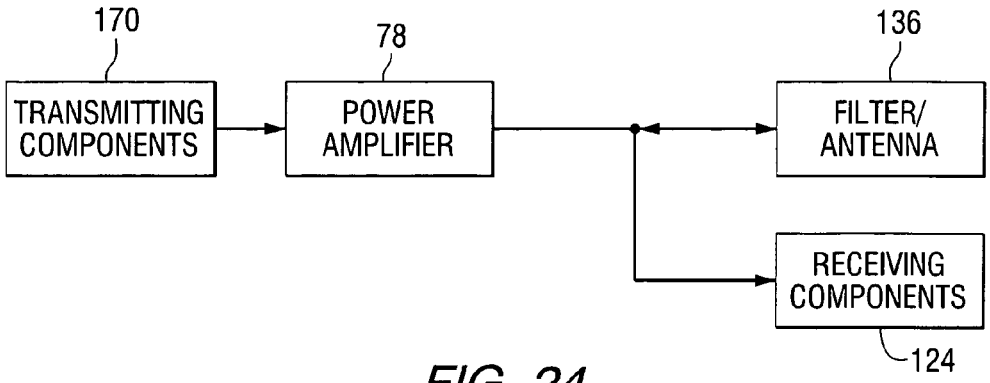
FIGS. 24 and 25 illustrate in block diagram form additional embodiments of the present invention.
Figure 25:
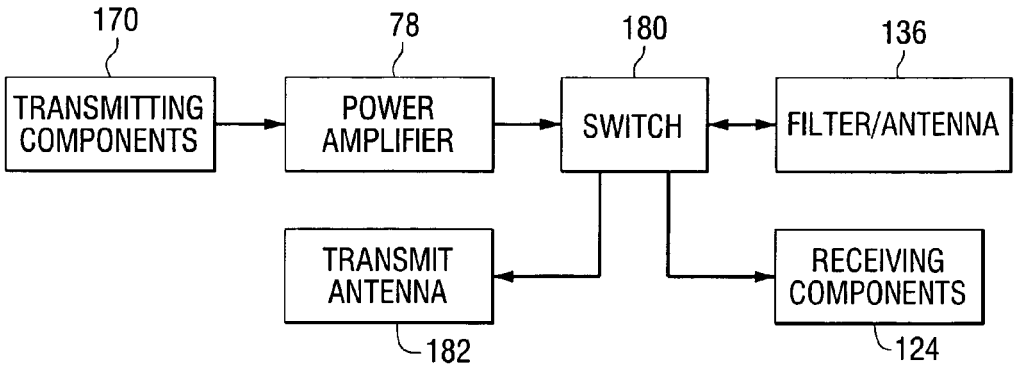

Two additional embodiments of the present invention are illustrated in FIGS. 24 and 25. Both Figures illustrate use of the integrated filter/antenna 136 in a communications device providing both transmit and receive functions. In the FIG. 24 embodiment, use of the switch 121 illustrated in FIG. 14 may not be required when the pass band of the integrated filter/antenna 136 includes the frequency of the transmitted signal.

The FIG. 25 embodiment can be used in an application where the transmitted signal is not within the pass band of the filter of the integrated filter/antenna 136, necessitating use of a switch 180 for operatively connecting a transmit antenna 182 to the transmitting components 170 in a transmit operational mode. In a receive operational mode, the switch 180 operatively connects the receiving components 124 to the integrated filter/antenna 136.

It is known that an antenna inherently provides a filtering function due to its limited performance bandwidth. Thus in the embodiments described above, analysis of the filtering capabilities of the integrated assembly can include the filtering function as determined by the antenna, plus the additional filtering provided by the filter. Certain antennas are dynamically tunable, such as a hula hoop antenna. The capacitance between the two terminals of the hula hoop is controllable by placing a variable capacitor across the terminals. Thus the antenna is tunable and thereby provides a tunable filtering function. Further, frequency selective antennas can by dynamically tuned to enhance the selectivity of the antenna against nearby in-band interfering signals. Likewise, the filter associated with the antenna element, as taught by the present invention, comprises a tunable filter by the inclusion of tunable components that change the resonant frequency and/or the bandwidth of the filter.

The dimensions and shapes of the various antenna elements and their respective features as described herein can be modified to permit operation in other frequency bands with other operational characteristics, including bandwidth, radiation resistance, input impedance, etc. Generally, changing the size of the various features changes only the antenna resonant frequency. The antenna can therefore be scaled to another resonant frequency by dimensional variation. For example, increasing the antenna volume, e.g., increasing the distance between the top plate 12 and the ground plane 16 tends to decrease the resonant frequency. Also, when the height is increased, the size of the top plate 12 should also be increased to provide the appropriate capacitive loading at the new resonant frequency.

While the invention has been described with reference to preferred embodiments, it will be understood by those skilled in the art that various changes may be made and equivalent elements may be substituted for elements thereof without departing from the scope of the present invention. The scope of the present invention further includes any combination of the elements from the various embodiments set forth herein. In addition, modifications may be made to adapt a particular situation to the teachings of the present invention without departing from its essential scope thereof. For example, different sized and shaped elements can be employed to form an antenna according to the teachings of the present invention. Therefore, it is intended that the invention not be limited to the particular embodiment disclosed as the best mode contemplated for carrying out this invention, but that the invention will include all embodiments falling within the scope of the appended claims.

What is claimed is:

1. An apparatus for receiving radio frequency signals, comprising:

an antenna for operating within a frequency band having an antenna reactance at antenna terminals;

a filter having a filter reactance at filter input terminals, the filter for producing a filtering effect on certain radio frequency signals; and wherein the antenna reactance and the filter reactance are opposite in sign and substantially equal in magnitude at frequencies within the frequency band, and wherein the antenna terminals are differentially connected to the filter input terminals to substantially cancel the effects of the antenna reactance and the filter reactance.

2. The apparatus of claim 1 further comprising receiving components responsive to the filter.

3. The apparatus of claim 2 further comprising a transmission line connecting the filter and the receiving components.

4. The apparatus of claim 3 wherein the transmission line comprises one of a fiber optic transmission line and a coaxial cable transmission line.

5. The apparatus of claim 1 wherein the antenna and the filter are disposed within a hand-held communications device.

6. The apparatus of claim 1 further comprising an antenna mast, wherein the filter and the antenna are located in an upper region of the mast.

7. The apparatus of claim 6 further comprising signal receiving components located proximate a base of the mast, and wherein the signal receiving components are connected to the filter by a transmission line.

8. The apparatus of claim 1 wherein the filter exhibits filtering characteristics, further comprising a controller for providing a signal to the filter for changing the filter characteristics.

9. An apparatus for receiving radio frequency signals:

an antenna for operating within a frequency band having an antenna reactance and comprising first and second spaced apart elements, wherein the first element is connected to an antenna feed terminal and the second element is connected to ground;

an electronics module disposed between the first and the second elements, wherein the electronics module comprises a filter having a filter reactance between first and second filter terminals and further comprising the first terminal and the second terminal differentially connected respectively to the first element and to the second element; and wherein the antenna reactance and the filter reactance are opposite in sign and substantially equal in magnitude at frequencies within the frequency band, and wherein the differential connection causes the antenna reactance to substantially cancel the filter reactance.

10. The apparatus of claim 9 wherein the antenna comprises a meanderline loaded antenna having a top plate, and wherein the first and the second spaced apart elements comprise a first and a second spaced apart leg element of the meanderline antenna, and wherein each of the first and the second leg elements are connected to the top plate via a meanderline conductor.

11. The apparatus of claim 9 operative for receiving and transmitting radio frequency signals, wherein the electronics module further comprises a power amplifier and a switch, and wherein the switch switchably connects one of the power amplifier and the filter to the first and the second spaced apart elements, and wherein the power amplifier is switchably connected to the first and the second elements when the apparatus is operative in the transmitting mode, and the filter is switchably connected to the first and the second elements when the apparatus is operative in the receiving mode.

12. An apparatus for receiving radio frequency signals, comprising:

a substrate;

antenna elements supported by the substrate, wherein each antenna element has an element reactance at element terminals; and a filter associated with each antenna element, each filter having input terminals, wherein a filter reactance of the filter is opposite in sign and substantially equal in magnitude to the element reactance of the associated antenna element, wherein the antenna element terminals are differentially connected to the filter input terminals causing the filter reactance to substantially cancel the element reactance.

13. The apparatus of claim 12 wherein the substrate comprises a cylindrical sleeve, and wherein the antenna elements are mounted on an outer surface of the sleeve.

14. The apparatus of claim 12 wherein the substrate comprises a polyhedron comprising a plurality of surfaces, and wherein the antenna elements are mounted on one or more of the surfaces.

15. The apparatus of claim 12 further comprising a signal processing element associated with each of the antenna elements for processing the signal received by the associated antenna element, wherein each signal processing element independently processes the signal received by the associated antenna element.

16. The apparatus of claim 15 wherein the filter exhibits filter characteristics, and wherein the signal processing element comprises a controller for controlling the filter characteristics.

17. The apparatus of claim 12 wherein each antenna element is collocated with the associated filter.

18. The apparatus of claim 12 wherein each antenna element is disposed in adjacent relationship with the associated filter.

19. The apparatus of claim 12 further comprising a power amplifier associated with each antenna element, wherein the apparatus operates in a transmitting mode and in a receiving mode, and wherein the power amplifier is operative in the transmitting mode and the filter is operative in the receiving mode.

* * * * *